US009599925B2

(12) United States Patent
Maeyama

(10) Patent No.: US 9,599,925 B2
(45) Date of Patent: Mar. 21, 2017

(54) IMAGE FORMING APPARATUS, CONTROL METHOD, AND NON-TRANSITORY STORAGE MEDIUM ENCODED WITH COMPUTER READABLE PROGRAM

(71) Applicant: Konica Minolta, Inc., Chiyoda-ku, Tokyo (JP)

(72) Inventor: Takeshi Maeyama, Ikeda (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 15/085,565

(22) Filed: Mar. 30, 2016

(65) Prior Publication Data

US 2016/0291504 A1 Oct. 6, 2016

(30) Foreign Application Priority Data

Mar. 31, 2015 (JP) ..... 2015-070753

(51) Int. Cl.

| | |
|---|---|
| ***G03G 15/08*** | (2006.01) |
| ***G03G 21/00*** | (2006.01) |
| *G03G 15/045* | (2006.01) |
| *G03G 21/08* | (2006.01) |

(52) U.S. Cl.
CPC ..... *G03G 15/0806* (2013.01); *G03G 21/0094* (2013.01); *G03G 15/045* (2013.01); *G03G 21/08* (2013.01)

(58) Field of Classification Search
CPC .. G03G 15/0806; G03G 15/045; G03G 21/08; G03G 21/0094
USPC ..... 399/53
See application file for complete search history.

(56) References Cited

U.S. PATENT DOCUMENTS

2015/0234312 A1* 8/2015 Funayama ..... G03G 15/065 399/55
2015/0331357 A1* 11/2015 Tsukamura ..... G03G 15/0848 399/53

FOREIGN PATENT DOCUMENTS

JP 2014-142472 A 8/2014

* cited by examiner

*Primary Examiner* — Hoang Ngo
(74) *Attorney, Agent, or Firm* — Buchanan Ingersoll & Rooney PC

(57) ABSTRACT

An image forming apparatus includes: an image carrier; an image forming unit configured to form, on the image carrier, an electrostatic latent image; a developing unit including a toner carrier configured to develop, on the image carrier, a toner image corresponding to the electrostatic latent image; an application unit configured to apply a lubricant onto the image carrier; a calculation unit configured to calculate an image portion ratio representing a ratio of a toner sticking region to the electrostatic latent image or the toner image; and a control unit configured to cause the lubricant mixed into the developing unit to stick to the toner carrier, and change, depending on the image portion ratio, an amount of the lubricant caused to stick to a non-image-formation region which is a region on the image carrier and in which the electrostatic latent image or the toner image is not formed.

19 Claims, 13 Drawing Sheets

IMAGE FORMING APPARATUS, CONTROL METHOD, AND NON-TRANSITORY STORAGE MEDIUM ENCODED WITH COMPUTER READABLE PROGRAM

This application is based on Japanese Patent Application No. 2015-070753 filed with the Japan Patent Office on Mar. 31, 2015, the entire content of which is hereby incorporated by reference.

BACKGROUND OF THE INVENTION

Field of the Invention

The present disclosure relates to control of an image forming apparatus, and particularly to control of an electrophotographic image forming apparatus.

Description of the Related Art

Electrophotographic image forming apparatuses such as multi-function peripheral, copier, and printer have become widespread. The electrophotographic image forming apparatus performs, in a printing process, the steps of: uniformly charging an image carrier while rotationally driving the image carrier; forming an electrostatic latent image by exposing the image carrier; causing toner to stick to the electrostatic latent image on the image carrier; transferring the toner image on the image carrier to a printed matter; and removing toner remaining on the image carrier.

In the step of removing toner remaining on the image carrier, a blade cleaning system, for example, is used. According to the blade cleaning system, a flat-plate-like cleaning blade made of an elastic body is brought into contact with the surface of the image carrier, and the cleaning blade removes toner remaining on the image carrier.

To meet the recent demand for enhanced image quality, the size of toner particles has been decreased. As a method of decreasing the size of toner particles, a polymerization method such as emulsion polymerization or suspension polymerization for example may be used. As the size of toner particles decreases, adhesion between toner particles and the image carrier increases, which makes it difficult to remove toner remaining on the image carrier.

The so-called polymerized toner manufactured by the polymerization method is substantially spherical, and therefore rolls on the image carrier. Due to this, the toner passes by the cleaning blade, namely the so-called "pass-by" occurs. As a result, a cleaning failure is likely to occur, which makes it still more difficult to remove toner remaining on the image carrier.

A method of solving this "pass-by" issue may be a method which applies onto the image carrier a solid lubricant such as metal salt of fatty acid. According to this method, the image forming apparatus applies the lubricant onto the image carrier to reduce the surface energy on the surface of the image carrier and thereby weaken the adhesion between the toner particles and the image carrier and accordingly remove the toner remaining on the image carrier.

Japanese Laid-Open Patent Publication No. 2014-142472 discloses an image forming apparatus controlling the amount of a lubricant applied onto an image carrier. In the image forming apparatus, the surface of the image carrier is divided into a plurality of regions extending in the direction crossing the rotational direction, to allow the lubricant to be uniformly applied to these regions. In this way, the image forming apparatus lessens wear of the image carrier which is caused by nonuniform application of the lubricant.

By way of example, the method of supplying a lubricant onto an image carrier includes a lubricant application mechanism system and a toner external additive system. In the case of the lubricant application mechanism system, a rotating brush is brought into contact with a solid lubricant which is called lubricant rod, and the lubricant scraped by the brush is supplied onto the surface of the image carrier. In the case of the toner external additive system, a toner containing a lubricant forms a toner image, and the toner itself functions as a lubricant.

In the case where the lubricant application mechanism system is employed, a part of the lubricant may be mixed into a developing unit. In the following, the lubricant mixed into the developing unit is also referred to as "mixed lubricant." The amount of the mixed lubricant increases or decreases depending on the image portion ratio at the time of image formation. "Image portion ratio" herein refers to the ratio of a toner sticking region, which is a region where toner sticks, to an electrostatic latent image or toner image. In the following, a region where toner sticks in an electrostatic latent image or toner image is also referred to as "image portion." Further, a region where the toner does not stick in an electrostatic latent image or toner image is also referred to as "background portion."

In the case where images with a low image portion ratio are successively given, the amount of the mixed lubricant increases. A possible reason for this is as follows. Specifically, in the image portion, the lubricant is covered with toner particles that are electrically stuck to the image carrier by a developing bias. Namely, lubricant particles are blocked by the toner particles. Therefore, the lubricant particles are not directly rubbed by a magnetic brush and almost no lubricant particle is mixed into the developing unit. In contrast, in the background portion, the lubricant is not blocked by toner particles, unlike the lubricant in the image portion. The lubricant is therefore directly rubbed by the magnetic brush and a certain ratio of the lubricant sticks to the magnetic brush and mixes into the developing unit. Accordingly, when images with a low image portion ratio are successively given, there is a high possibility that the lubricant is mixed into the developing unit from the background portion and the amount of the mixed lubricant increases.

On the contrary, when images with a high image portion ratio are successively given, the amount of the lubricant mixed into the developing unit from the background portion decreases. In addition, a certain ratio of the mixed lubricant is discharged from the developing unit as will be described later herein, and the amount of the mixed lubricant accordingly decreases.

In view of the above, a problem is now described that arises in the case where images each having an image portion ratio lower than an average are successively given and in the case where images each having an image portion ratio higher than an average are successively given.

In the case where images with a low image portion ratio are successively given, the amount of the mixed lubricant increases as described above. The lubricant which is mixed into the developing unit is electrically charged to a polarity opposite to the toner due to triboelectric charging resultant from friction with the toner. The lubricant particles stick to a carrier which serves to electrically charge the toner, to thereby hinder the toner from being electrically charged, and the lubricant particles also stick to the toner itself to thereby reduce the charge amount of the toner. When the charge amount of the toner is excessively reduced, a problem that the toner sticks to the background portion (so-called fog), or a problem that the toner spills from the developing unit occurs.

On the contrary, in the case where images with a high image portion ratio are successively given, the amount of the mixed lubricant decreases as described above. The mixed lubricant is discharged little by little from the developing unit during image formation. The mixed lubricant is discharged due to the following two factors.

The first factor is that the lubricant sticking to the toner is discharged together with the toner when the image portion is developed with the toner. The second factor is that the lubricant particles which are electrically charged to the opposite polarity to the toner stick to the background portion and the lubricant particles are moved by an electric field from the developing unit toward the image carrier. As a result, when images with a high image portion ratio are successively given, the amount of the mixed lubricant decreases to become smaller than a normal amount.

The mixed lubricant may also act to reduce the charge amount of the toner. In the case where the image portion ratio is lower than a certain value, an average amount of the mixed lubricant is replaced. Thus, the charge amount of the toner becomes stable. However, in the case where the image portion ratio is higher than a certain value, there arises a problem that the charge amount of the toner is excessively large.

A reason for this problem is as follows. The toner is electrically charged through triboelectric charging resultant from friction with the carrier. The triboelectric charging ability of the toner gradually decreases with time for which the toner stays in the developing unit. This may be caused due to the fact that an external additive contained in the toner is immersed or separated because of stress in the developing unit. The toner is manufactured so that the charge amount is appropriate, on the precondition that printing is done at an average image portion ratio and on the precondition that the toner stays in the developing unit for a certain time.

However, in the case where images with a high image portion ratio are successively given, the toner in the developing unit is successively replaced with newly fed toner, and the time for which the toner stays in the developing unit is extremely shorter than an expected time. As a result, the charge amount of the toner in the developing unit is excessively large. Moreover, the fact that the amount of the mixed lubricant is smaller than normal also promotes the increase of the charge amount of the toner. Further, in the case where replenishment with toner is not timely and the Tc ratio of the developer (the ratio of the toner to the developer) becomes low, the charge amount of the toner particularly increases.

As seen from the above, when images with a high image portion ratio are successively given, the charge amount of the toner becomes excessively large. As a result, the developability is deteriorated and the printing quality is considerably deteriorated.

Therefore, desirably a constant amount of the lubricant is contained in the developing unit. The image forming apparatus disclosed in Japanese Laid-Open Patent Publication No. 2014-142472 aims to apply a uniform amount of the lubricant to the image carrier, rather than to keep constant the amount of the lubricant contained in the developing unit.

SUMMARY OF THE INVENTION

The present disclosure is given to provide a solution to the above-described problems. An object in an aspect is to provide an image forming apparatus that can suppress variation of the amount of the lubricant mixed into the developing unit. An object in another aspect is to provide a control method for an image forming apparatus that can suppress variation of the amount of the lubricant mixed into the developing unit. An object in still another aspect is to provide a non-transitory storage medium encoded with a computer readable program that can suppress variation of the amount of the lubricant mixed into the developing unit.

According to an aspect, an image forming apparatus includes: an image carrier; an image forming unit configured to form, on the image carrier, an electrostatic latent image corresponding to an input image; a developing unit including a toner carrier configured to develop, on the image carrier, a toner image corresponding to the electrostatic latent image, by causing a toner held in the developing unit to stick to the image carrier; an application unit configured to apply a lubricant onto the image carrier; a calculation unit configured to calculate an image portion ratio which represents a ratio of a toner sticking region to the electrostatic latent image or the toner image; and a control unit configured to cause the lubricant mixed into the developing unit in a process of developing the toner image, to stick to the toner carrier, and change, depending on the image portion ratio, an amount of the lubricant caused to stick to a non-image-formation region which is a region on the image carrier and in which the electrostatic latent image or the toner image is not formed.

Preferably, the control unit is configured to decrease the amount of the lubricant mixed into the developing unit and caused to stick to the non-image-formation region, as the image portion ratio increases.

Preferably, the control unit is configured to increase the amount of the lubricant mixed into the developing unit and caused to stick to the non-image-formation region, as the image portion ratio decreases.

Preferably, the control unit is configured to stepwise change, among three or more levels, the amount of the lubricant caused to stick to the non-image-formation region, depending on the image portion ratio.

Preferably, the control unit is configured to control a voltage applied to at least one of the non-image-formation region and the toner carrier, so that a first potential difference between the lubricant mixed into the developing unit and the non-image-formation region is smaller than a second potential difference between the lubricant and the toner carrier, as the image portion ratio increases.

Preferably, the control unit is configured to apply an AC voltage to the toner carrier, and change the second potential difference by changing an amplitude of the AC voltage.

Preferably, the control unit is configured to change the first potential difference by changing a voltage applied to the non-image-formation region.

Preferably, the control unit is configured to apply an AC voltage to the toner carrier, and lower a frequency of the AC voltage as the image portion ratio increases.

Preferably, the image forming apparatus has, as operation modes, a first mode of causing the toner to stick to the non-image-formation region and discharging the toner from the developing unit; and a second mode of causing the lubricant to stick to the non-image-formation region and discharging the lubricant from the developing unit. The image forming apparatus further includes an operation mode control unit configured to control the operation modes so that sticking of the toner in the first mode and sticking of the lubricant in the second mode are not performed for the one non- image-formation region.

According to another aspect, a control method for an image forming apparatus is provided. The image forming apparatus includes: an image carrier; an image forming unit configured to form, on the image carrier, an electrostatic latent image corresponding to an input image; a developing unit including a toner carrier configured to develop, on the image carrier, a toner image corresponding to the electrostatic latent image, by causing a toner held in the developing unit to stick to the image carrier; and an application unit configured to apply a lubricant onto the image carrier. The control method includes: calculating an image portion ratio which represents a ratio of a toner sticking region to the electrostatic latent image or the toner image; causing the lubricant mixed into the developing unit in a process of developing the toner image, to stick to the toner carrier; and changing, depending on the image portion ratio, an amount of the lubricant caused to stick to a non-image-formation region which is a region on the image carrier and in which the electrostatic latent image or the toner image is not formed.

Preferably, the changing an amount of the lubricant caused to stick to a non-image-formation region includes: decreasing the amount of the lubricant mixed into the developing unit and caused to stick to the non-image-formation region, as the image portion ratio increases.

Preferably, the changing an amount of the lubricant caused to stick to a non-image-formation region includes: increasing the amount of the lubricant mixed into the developing unit and caused to stick to the non-image-formation region, as the image portion ratio decreases.

Preferably, the changing an amount of the lubricant caused to stick to a non-image-formation region includes: stepwise changing, among three or more levels, the amount of the lubricant caused to stick to the non-image-formation region, depending on the image portion ratio.

Preferably, the changing an amount of the lubricant caused to stick to a non-image-formation region includes: controlling a voltage applied to at least one of the non-image-formation region and the toner carrier, so that a first potential difference between the lubricant mixed into the developing unit and the non-image-formation region is smaller than a second potential difference between the lubricant and the toner carrier, as the image portion ratio increases.

According to still another aspect, a non-transitory storage medium encoded with a computer readable program executed by a computer of an image forming apparatus is provided. The image forming apparatus includes: an image carrier; an image forming unit configured to form, on the image carrier, an electrostatic latent image corresponding to an input image; a developing unit including a toner carrier configured to develop, on the image carrier, a toner image corresponding to the electrostatic latent image, by causing a toner held in the developing unit to stick to the image carrier; and an application unit configured to apply a lubricant onto the image carrier. The program causes the image forming apparatus to calculate an image portion ratio which represents a ratio of a toner sticking region to the electrostatic latent image or the toner image, cause the lubricant mixed into the developing unit in a process of developing the toner image, to stick to the toner carrier, and change, depending on the image portion ratio, an amount of the lubricant caused to stick to a non-image-formation region which is a region on the image carrier and in which the electrostatic latent image or the toner image is not formed.

Preferably, to change an amount of the lubricant caused to stick to a non-image-formation region includes: to decrease the amount of the lubricant mixed into the developing unit and caused to stick to the non-image-formation region, as the image portion ratio increases.

Preferably, to change an amount of the lubricant caused to stick to a non-image-formation region includes: to increase the amount of the lubricant mixed into the developing unit and caused to stick to the non-image-formation region, as the image portion ratio decreases.

Preferably, to change an amount of the lubricant caused to stick to a non-image-formation region includes: to stepwise change, among three or more levels, the amount of the lubricant caused to stick to the non-image-formation region, depending on the image portion ratio.

Preferably, to change an amount of the lubricant caused to stick to a non-image-formation region includes: to control a voltage applied to at least one of the non-image-formation region and the toner carrier, so that a first potential difference between the lubricant mixed into the developing unit and the non-image-formation region is smaller than a second potential difference between the lubricant and the toner carrier, as the image portion ratio increases.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
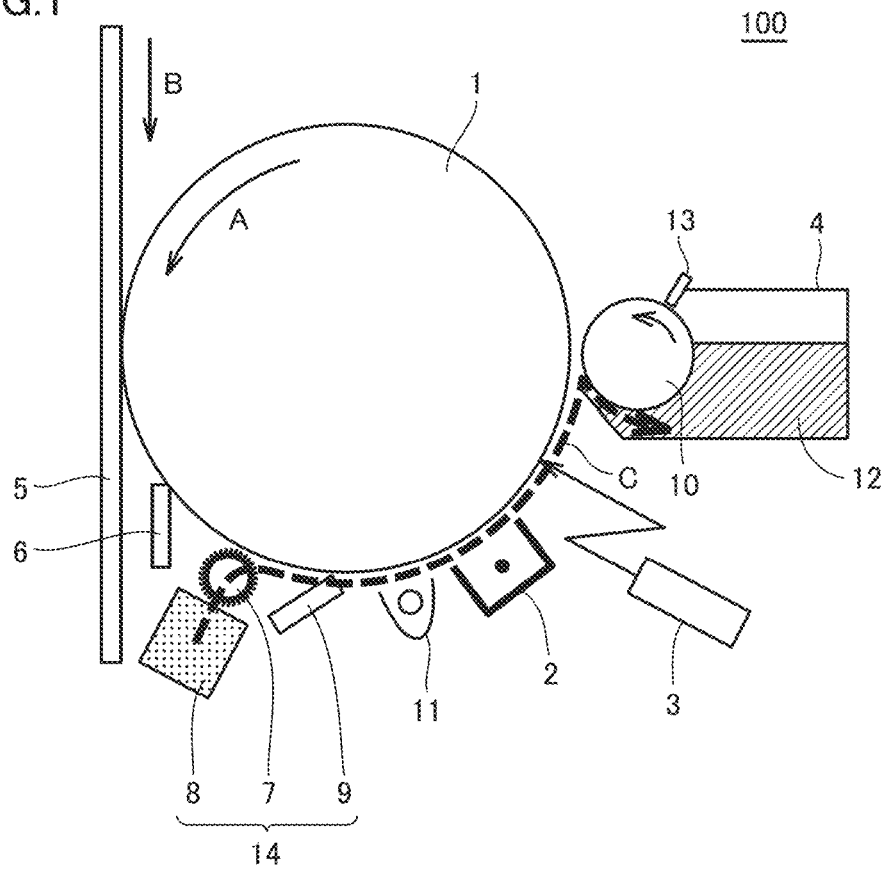
FIG. 1 is a diagram showing an external view of a developing unit included in an image forming apparatus according to a first embodiment.

In the following, embodiments of the present invention will be described with reference to the drawings. In the following description, the same components and the same elements are denoted by the same reference characters. They are named identically and function identically. Therefore, a detailed description of them will not be repeated herein. The embodiments and modifications described below may be selectively combined as appropriate.

First Embodiment

Hardware Configuration of Image Forming Apparatus 100

Referring to FIG. 1, a description will be given of the hardware of an image forming apparatus 100 according to a first embodiment. FIG. 1 is a diagram showing an external view of a developing unit included in image forming apparatus 100. Image forming apparatus 100 is for example MFP (Multi-Functional Peripheral).

As shown in FIG. 1, image forming apparatus 100 includes an image carrier 1 shown as a photoreceptor, a charging device 2, an exposure device 3, a developing unit 4, an intermediate transfer member 5, a cleaning member 6, an eraser lamp 11, and a lubricant application mechanism 14.

Image carrier 1 has a cylindrical shape having a surface where a photoreceptor layer (not shorn) is formed. Image carrier 1 is rotationally driven in the direction indicated by an arrow A in FIG. 1. On the outer periphery of image carrier 1, charging device 2, exposure device 3, developing unit 4, intermediate transfer member 5, cleaning member 6, eraser lamp 11, and lubricant application mechanism 14 are arranged in order in the rotational direction of image carrier 1.

Charging device 2 uniformly charges the surface of image carrier 1 to a predetermined potential. Typically, charging device 2 negatively charges the surface of image carrier 1.

Exposure device 3 irradiates the surface of image carrier 1 with light to lower the charge level in the irradiated region and thereby form, on image carrier 1, an electrostatic latent image corresponding to an input image.

Developing unit 4 includes a developer carrier 10. A developer 12 containing a toner and a carrier sticks to the surface of developer carrier 10. Developer carrier 10 transports developer 12 to a development region on image carrier 1 to develop a toner image corresponding to the electrostatic latent image formed on image carrier 1. In this development process, a development bias voltage is applied from a power supply (not shown) to developer carrier 10. The toner contained in developer 12 is caused to stick to the electrostatic latent image on image carrier 1 by an electric field which is generated due to a relation with the potential of the electrostatic latent image on image carrier 1. In this way, the toner image corresponding to the electrostatic latent image is developed on image carrier 1.

In image forming apparatus 100 in FIG. 1, an intermediate transfer unit (not shown) includes intermediate transfer member 5 and a secondary transfer member (not shown).

Intermediate transfer member 5 is disposed to face image carrier 1. Intermediate transfer member 5 is moved in the direction indicated by an arrow B while keeping contact with image carrier 1. The toner image formed on image carrier 1 is primarily transferred to intermediate transfer member 5 at an NIP portion (contact portion) between image carrier 1 and intermediate transfer member 5.

In the primary transfer process, a transfer bias voltage is applied from a power supply (not shown) to intermediate transfer member 5. Accordingly, an electric field is formed at a primary transfer portion located between image carrier 1 and intermediate transfer member 5. As a result, the toner image on image carrier 1 is electrostatically attracted to intermediate transfer member 5 and thus transferred to intermediate transfer member 5.

Once the toner image is transferred to intermediate transfer member 5, cleaning member 6 removes the toner remaining on image carrier 1, and image forming apparatus 100 is prepared for the next image formation. By way of example, cleaning member 6 is a flat-plate-like cleaning blade made of an elastic body. As a cleaning system, a blade cleaning system for example is employed by which the toner remaining on image carrier 1 is removed while the cleaning blade is kept in contact with image carrier 1.

Lubricant application mechanism 14 for applying a lubricant to image carrier 1 is provided downstream (in rotational direction A) of cleaning member 6. Lubricant application mechanism 14 includes a lubricant application member 7, a solid lubricant 8, and a lubricant fixing member 9. Lubricant application mechanism 14 scrapes the lubricant from solid lubricant 8 and applies the lubricant to the surface of image carrier 1. Details of lubricant application mechanism 14 will be given later herein.

Between lubricant application mechanism 14 and charging device 2, eraser lamp 11 for erasing the electrostatic latent image is provided as required. Thus, the electrostatic latent image is completely erased before the next image formation, and the next image is formed with a high sharpness.

The toner image transferred to intermediate transfer member 5 is provided to undergo a secondary transfer process (not shown). In the secondary transfer process, the toner image on intermediate transfer member 5 is transferred to a recording medium through electrostatic attraction caused by an electric field. Once the toner image is transferred onto the recording medium, the toner remaining on intermediate transfer member 5 is removed, and the next primary transfer is performed. The recording medium to which the toner image is transferred is conveyed to a fixing device (not shown). Image forming apparatus 100 heats and thereby melts the toner image on the recording medium, and thus fixes the toner image on the recording medium.

Although FIG. 1 shows an example where image forming apparatus 100 includes only one set of image carrier 1 and developer 4 and forms a monochrome image, image forming apparatus 100 may be configured to form a color image. By way of example, image forming apparatus 100 may include developer 4 or a set of image carrier 1 and developer 4 for each of the colors cyan (C), magenta (M), yellow (Y), and black (K). Accordingly, image forming apparatus 100 can form respective images of the colors CMYK, and superimpose these images on one another on intermediate transfer member 5 or recording medium.

Above-described intermediate transfer member 5 may be dispensed with. In this case, image forming apparatus 100 directly transfers the toner image from image carrier 1 to the recording medium. Besides, conventionally used electrophotographic processes may be combined for any configuration of image forming apparatus 100, so as to meet the purpose of image forming apparatus 100.

Overview of Operation of Image Forming Apparatus 100

Figure 2A:
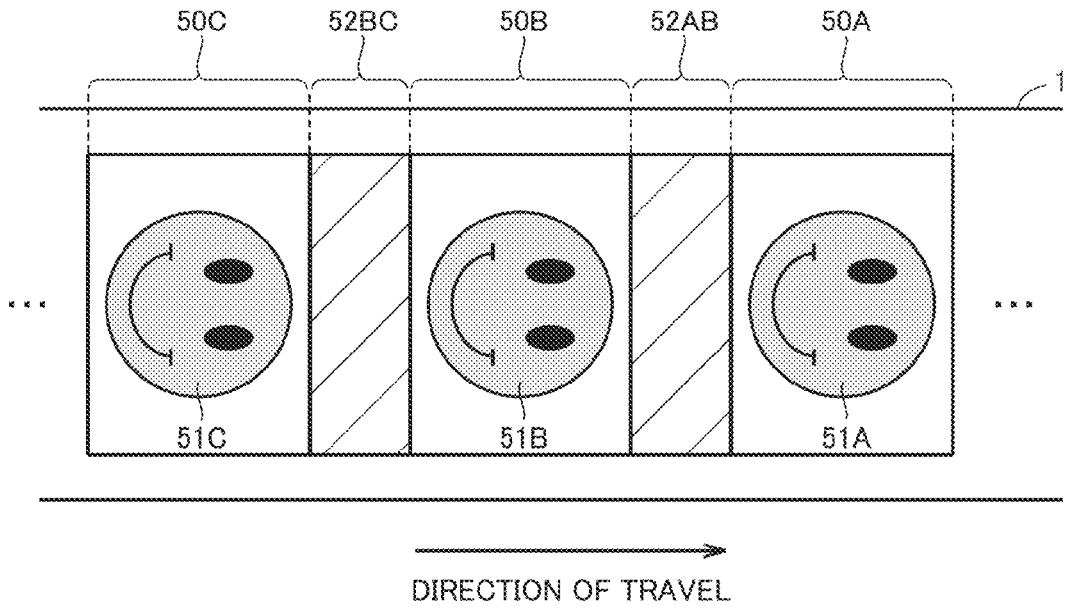
FIG. 2A and FIG. 2B are each a developed view of the surface of an image carrier according to the first embodiment.
Figure 2B:
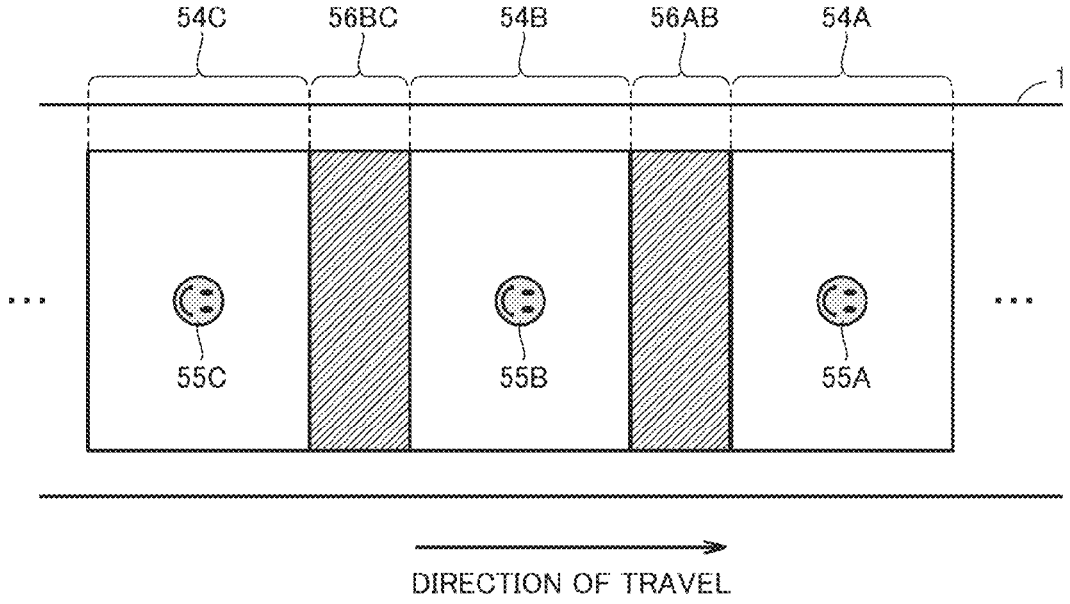

Referring to FIG. 2A and FIG. 2B, an overview of an operation of image forming apparatus 100 will be described. FIG. 2A and FIG. 2B are each a developed view of the surface of image carrier 1.

As described above, the amount of the lubricant mixed into developing unit 4 (namely mixed lubricant) during development of the toner image varies depending on the image portion ratio representing the ratio of the toner sticking region to the electrostatic latent image or the toner image. More specifically, the amount of the mixed lubricant is smaller as the image portion ratio is higher. On the contrary, the amount of the mixed lubricant is larger as the image portion ratio is lower. Image forming apparatus 100 in the present embodiment causes the mixed lubricant to stick to developer carrier 10 (see FIG. 1), and changes, depending on the image portion ratio, the amount of the lubricant to be stuck to a non-image-formation region which is a region on image carrier 1 and in which the electrostatic latent image or toner image is not formed. In this way, image forming apparatus 100 can suppress variation, depending on the image portion ratio, of the amount of the lubricant mixed into the developing unit.

In an aspect, as shown in FIG. 2A it is supposed that an electrostatic latent image or toner image is formed in image formation regions 50A to 50C on image carrier 1. Image formation regions 50A to 50C include image portions 51A to 51C which are each a toner sticking region. The aforementioned image portion ratio refers to the ratio of each of image portions 51A to 51C to a corresponding one of image formation regions 50A to 50C. Image forming apparatus 100 causes the mixed lubricant to stick to non-image-formation regions 52AB, 52BC between image formation regions 50A to 50C to thereby discharge the mixed lubricant from developing unit 4. At this time, as the image portion ratio is higher, image forming apparatus 100 reduces the amount of the mixed lubricant which is caused to stick to non-image-formation regions 52AB, 52BC. In this way, image forming apparatus 100 can keep constant the amount of the mixed lubricant even when images with a high image portion ratio are successively given.

In another aspect, as shown in FIG. 2B, it is supposed that an electrostatic latent image or toner image is formed in image formation regions 54A to 54C on image carrier 1. Image formation regions 54A to 54C include image portions 55A to 55C, respectively, which are each a toner sticking region. Image forming apparatus 100 causes the mixed lubricant to stick to non-image-formation regions 56AB, 56BC between image formation regions 54A to 54C to thereby discharge the mixed lubricant from developing unit 4. At this time, as the image portion ratio is lower, image forming apparatus 100 increases the amount of the mixed lubricant which is caused to stick to non-image-formation regions 56AB, 56BC. In this way, image forming apparatus 100 can keep constant the amount of the mixed lubricant even when images with a low image portion ratio are successively given.

While FIG. 2A and FIG. 2B show an example where image forming apparatus 100 changes the discharge amount of the mixed lubricant between two levels, image forming apparatus 100 may stepwise change, among three or more levels, the amount of the lubricant caused to stick to the non-image-formation region, depending on the image portion ratio. Further, it may not be necessary to stepwise change the discharge amount of the mixed lubricant, and the discharge amount may be changed proportionally to the image portion ratio.

Developer 12

Referring again to FIG. 1, developer 12 will be described. Developer 12 contains a toner and a carrier for electrically charging the toner.

The type of toner is not particularly limited. As the toner, a commonly used and known toner is used. By way of example, the toner contains a coloring agent in a binder resin. Alternatively, the toner may contain a charge controlling agent, a release agent, and the like as required. Alternatively, the toner may contain an external additive. The toner may have any particle size, and the particle size is preferably on the order of 3 to 15 μm.

The type of carrier is not particularly limited. As the carrier, a commonly used and known carrier is used. For example, the carrier is a binder-type carrier or a coat-type carrier. The carrier may have any particle size, and the particle size is preferably on the order of 15 to 100 μm.

Lubricant Application Mechanism 14

Referring still to FIG. 1, lubricant application mechanism 14 will be described. Lubricant application mechanism 14 includes lubricant application member 7, solid lubricant 8, and lubricant fixing member 9.

Solid lubricant 8 is applied to the surface of image carrier 1 to reduce its surface energy and thereby weaken the adhesion between the toner and image carrier 1. As solid lubricant 8, for example, metal salt of fatty acid, fluorine-based resin, or the like is used. The metal salt of fatty acid and the fluorine-based resin may be mixed and used as solid lubricant 8, or may singly be used as solid lubricant 8.

Preferably, solid lubricant 8 includes a metal salt of fatty acid. As the fatty acid forming the metal salt of fatty acid, straight-chain hydrocarbon is preferred. Examples of the hydrocarbon may be myristic acid, palmitic acid, stearic acid, oleic acid, and the like. Among them, stearic acid is more preferred.

Examples of the metal forming the metal salt of fatty acid may be lithium, magnesium, calcium, strontium, zinc, cadmium, aluminum, cerium, titanium, iron, and the like. Examples of the fatty acid and the metal forming the metal salt of fatty acid may be zinc stearate, magnesium stearate, aluminum stearate, iron stearate, and the like. In particular, zinc stearate is more preferred.

As to solid lubricant 8, the aforementioned materials are melted and molded into a shape which can be scraped, and used as a solid lubricant. Alternatively, as to solid lubricant 8, particles of the aforementioned materials are compression-molded into a shape which can be scraped, and used as a solid lubricant.

Examples of lubricant application member 7 may for example be brush, sponge, and the like. Among them, the brush is suitable for use. Lubricant application member 7 is provided to contact both image carrier 1 and solid lubricant 8, and supplies lubricant particles scraped from solid lubricant 8 to image carrier 1. At this time, lubricant application member 7 presses lubricant particles against image carrier 1 to apply and spread the lubricant particles on image carrier 1.

The rotational direction of lubricant application member 7 may be the "with" direction with respect to image carrier 1 (respective surfaces at the contact portion move in the same direction) or the "counter" direction with respect to image carrier 1 (respective surfaces at the contact portion move in opposite directions). In order for a greater amount of lubricant particles to be applied and spread on image carrier 1, the counter direction is preferred. The circumferential velocity ratio may either be "1" or other than "1."

Lubricant fixing member 9 is disposed adjacent to lubricant application member 7 and located downstream in rotational direction A. Lubricant fixing member 9 further spreads the lubricant which is supplied onto image carrier 1 by lubricant application member 7, and also removes excessive lubricant particles applied on image carrier 1. As a material for lubricant fixing member 9, a flat-plate-like blade made of an elastic body is used, like cleaning member 6. It should be noted that lubricant fixing member 9 is not a requisite part, and lubricant application mechanism 14 may include at least lubricant application member 7 and solid lubricant 8.

Problems of Lubricant Application Mechanism 14

Referring still to FIG. 1, problems in the case where the lubricant is supplied from lubricant application mechanism 14 will be described.

As described above, solid lubricant 8 is scraped by lubricant application member 7. The scraped lubricant particles are supplied from lubricant application member 7 onto image carrier 1, and spread on image carrier 1 by lubricant application member 7 and lubricant fixing member 9. However, there is a possibility that the lubricant particles may not sufficiently be fixed on image carrier 1 when the lubricant particles have merely passed through lubricant application member 7 once and passed through lubricant fixing member 9 once. The lubricant which is not sufficiently fixed proceeds along a path C shown in FIG. 1 and is mixed at the development NIP portion into developing unit 4.

As described above, the amount of the lubricant mixed into developing unit 4 (namely mixed lubricant) varies depending on the image portion ratio at the time of image formation. The variation of the amount of the mixed lubricant causes the following problems.

In the case where images with a low image portion ratio are successively given, the amount of the mixed lubricant increases as described above. The lubricant particles which are mixed into the developing unit are electrically charged to a polarity opposite to the toner due to triboelectric charging resultant from friction with the toner. The lubricant particles which are electrically charged to the opposite polarity stick to the carrier to thereby hinder the toner from being electrically charged, and the lubricant particles also stick to the toner to thereby reduce the charge amount of the toner. When the amount of the lubricant mixed into the developing unit exceeds a certain amount, the charge amount of the toner is excessively reduced. The excessive reduction of the charge amount of the toner causes the toner to stick to the background portion (so-called fog), or causes the toner to spill from the developing unit.

On the contrary, in the case where images with a high image portion ratio are given successively, the amount of the mixed lubricant decreases as described above. The mixed lubricant may act to reduce the charge amount of the toner. In the case where the image portion ratio is lower than a certain value, an average amount of the toner in the developing unit is replaced. Thus, the charge amount of the toner becomes stable. However, in the case where the image portion ratio is higher than a certain value, there arises a problem that the charge amount of the toner is excessively large.

A reason why the charge amount of the toner is excessively large when the image portion ratio is higher than a certain value is as follows. The toner is electrically charged through triboelectric charging resultant from friction with the carrier. The triboelectric charging ability of the toner gradually decreases with the time for which the toner stays in the developing unit. This may be caused due to the fact that an external additive contained in the toner is immersed or released because of stress in the developing unit. The toner is manufactured so that the charge amount is appropriate, on the precondition that printing is done at an average image portion ratio and on the precondition that the toner stays in the developing unit for a certain time.

However, in the case where images with a high image portion ratio are successively given, the toner in the developing unit is successively replaced with newly fed toner. The time for which the toner stays in the developing unit is extremely shorter than expected, and the charge amount of the toner in the developing unit is excessively large. Moreover, the fact that the amount of the mixed lubricant is smaller than normal also promotes the increase of the charge amount of the toner. Further, in the case where replenishment with toner is not timely and the Tc ratio of the developer (the ratio of the toner to the developer) becomes low, the charge amount of the toner particularly increases. As the Tc ratio is higher, the toner is more likely to be charged and the charge amount increases. A main problem that arises due to the increase of the chargeability of the toner may be deterioration of the developability.

Time Taken for the Amount of Mixed Lubricant to Vary

The amount of the mixed lubricant does not vary over a short time. Generally, the amount of the lubricant mixed into the developing unit and the amount of the lubricant discharged from the developing unit per page are slight amounts. The amount of the mixed lubricant varies over a time which is long to a certain extent. Namely, the amount of the mixed lubricant varies depending on the average of the image portion ratio of images formed in a certain period in the past. The length of "certain period" is determined by the amount of the developer in developing unit 4, the amount of the lubricant supplied from lubricant application mechanism 14, the lubricant application and spread ability of lubricant application member 7 and lubricant fixing member 9, and the like.

Usually, when an electrophotographic image forming apparatus has printed about several thousands to several tens of thousands of sheets of A4 size, the amount of the mixed lubricant changes. Therefore, image forming apparatus 100 controls the amount of the mixed lubricant based on the average of the image portion ratio of about several thousands to several tens of thousands of sheets. Therefore, the aforementioned "case where images with a low image portion ratio are successively given" and "case where images with a high image portion ratio are successively given" are each determined based on the average of the image portion ratio over "a certain period" which is defined depending on various conditions of the image forming apparatus.

Behavior of Lubricant from Developing Unit 4 to Image Carrier 1

Figure 3A:
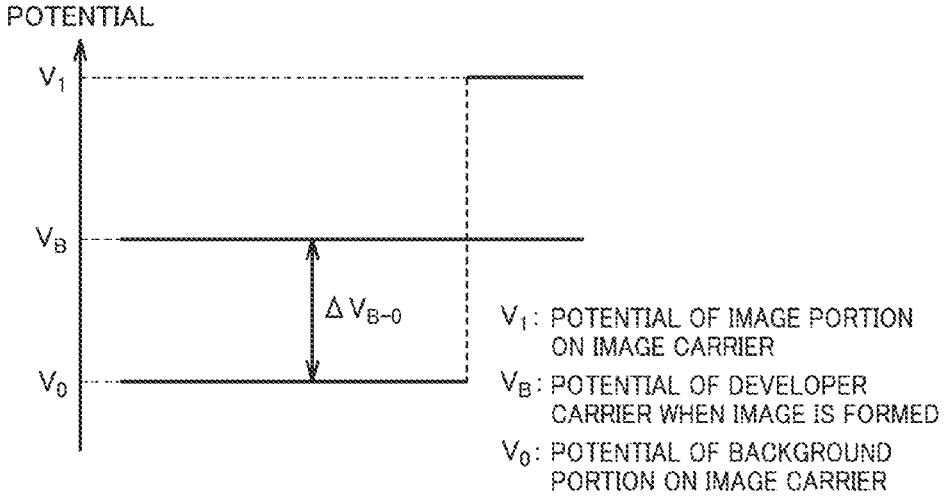
FIG. 3A, FIG. 3B, and FIG. 3C are each a diagram showing a potential applied to an image carrier and a developer carrier according to the first embodiment.
Figure 3B:
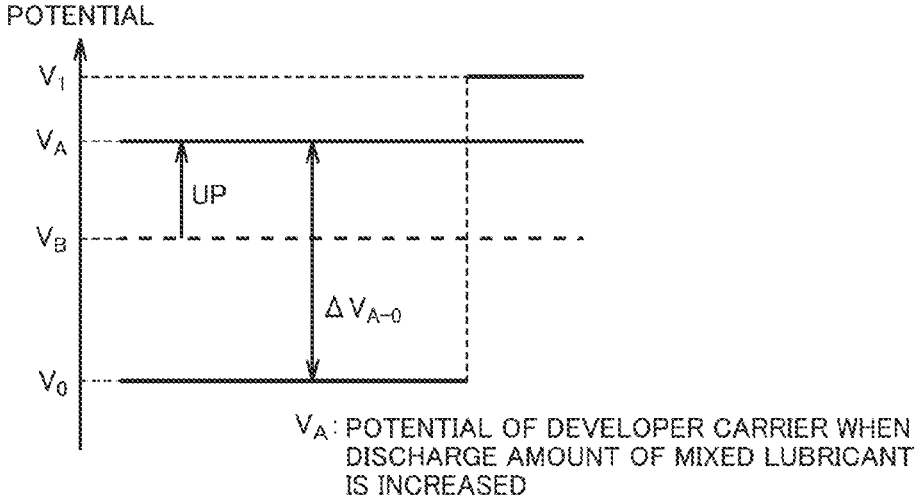
Figure 3C:
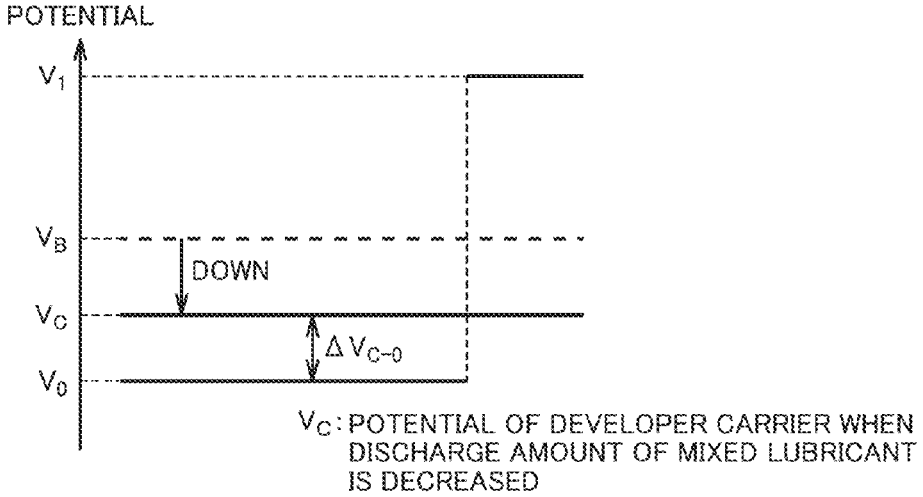
Figure 4A:
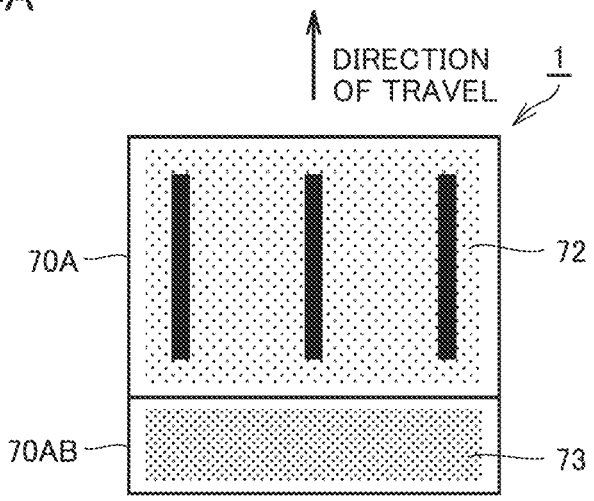
FIG. 4A and FIG. 4B are diagrams showing a difference in the sticking amount of a mixed lubricant on an image carrier according to the first embodiment.
Figure 4B:
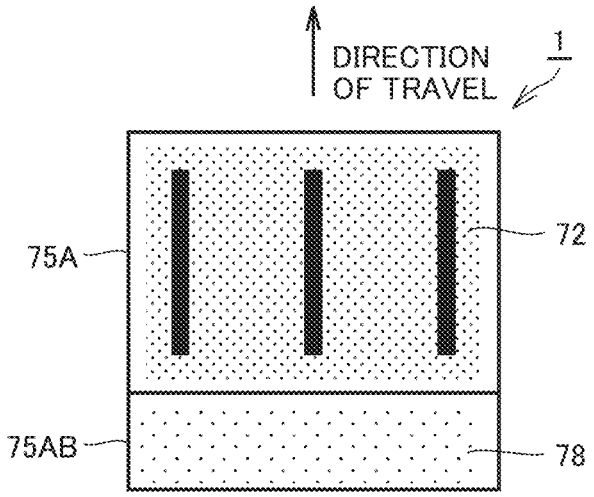

Referring still to FIG. 1 and also FIG. 3A to FIG. 3C, FIG. 4A, and FIG. 4B, a description will be given of the behavior of the lubricant mixed into developing unit 4 when development is done. FIG. 3A, FIG. 3B, and FIG. 3C are each a diagram showing a potential applied to image carrier 1 and developer carrier 10. FIG. 4A and FIG. 4B are diagrams showing a difference in the sticking amount of the mixed lubricant on image carrier 1. In the following, it is supposed that the toner is normally charged to the negative polarity.

The mixed lubricant is charged to the opposite polarity to the toner, due to the triboelectric charging resultant from friction with the toner. Namely, the mixed lubricant is charged to the positive polarity. The mixed lubricant is stuck to developer carrier 10 and transported to the development NIP, and subjected to a force in the opposite direction to the toner, due to a development electric field. As a result, a part of the mixed lubricant is moved by the electric field to the background portion on image carrier 1, and transported to image carrier 1. Since basically the toner does not stick to the background portion, it is only the lubricant that sticks to the background portion.

Movement of the mixed lubricant from developer carrier 10 to image carrier 1 occurs not only on the background portion of the image formation region but also in the non-image-formation region. It is supposed as shown in FIG. 3A for example that image forming apparatus 100 applies potential $V_0$ to the background portion of image carrier 1 and the non-image-formation region of image carrier 1, and applies potential $V_1$ (>potential $V_0$) to the image portion of image carrier 1. It is also supposed that image forming apparatus 100 applies potential $V_B$ to developer carrier 10. Potential $V_B$ is higher than potential $V_0$ and lower than potential $V_1$. As a result, a potential difference $\Delta V_{B\text{-}0}$ arises between the background portion of image carrier 1 and developer carrier 10 and between the non-image-formation region of image carrier 1 and developer carrier 10. Accordingly, the amount of the mixed lubricant moving from the background portion to image carrier 1 becomes equal to the amount of the mixed lubricant moving from the non-image-formation region to image carrier 1.

The movement of the mixed lubricant from developer carrier 10 to the non-image-formation region is electrical movement, and therefore, the amount of moved lubricant varies depending on the potential difference (bias condition) between image carrier 1 and developer carrier 10. Namely, with increase of this potential difference, the force causing the mixed lubricant to be attracted to the non-image-formation region of image carrier 1 increases and thus the amount of the moved mixed lubricant increases. Therefore, image forming apparatus 100 differently applies the potential to image carrier 1 and the potential to developer carrier 10 depending on the image formation region and the non-image-formation region, and can accordingly control the sticking amount of the mixed lubricant sticking to the non-image-formation region.

In view of the above, image forming apparatus 100 controls the voltage applied to at least one of the non-image-formation region and developer carrier 10, so that the potential difference between the mixed lubricant and the non-image-formation region is smaller than the potential difference between the mixed lubricant and developer carrier 10. Accordingly, the force which causes the mixed lubricant to be attracted to the non-image-formation region of image carrier 1 increases, and the amount of the mixed lubricant moved from developer carrier 10 to the non-image-formation region increases.

Moreover, image forming apparatus 100 controls the voltage applied to at least one of the non-image-formation region and developer carrier 10, so that the potential difference between the mixed lubricant and the non-image-formation region is smaller than the potential difference between the mixed lubricant and developer carrier 10, with decrease of the image portion ratio. Accordingly, the force which causes the mixed lubricant to be attracted to the non-image-formation region of image carrier 1 is weakened, and the amount of the mixed lubricant moving from developer carrier 10 to the non-image-formation region decreases.

By way of example, image forming apparatus 100 changes the voltage of developer carrier 10 as shown in FIG. 3A to thereby control the discharge amount of the mixed lubricant. In the case where image forming apparatus 100 applies voltage $V_B$ at the time of image formation, the lubricant moves to the background portion in accordance with potential difference $\Delta V_{B\text{-}0}$.

As shown in FIG. 3B, as image forming apparatus 100 changes potential difference $\Delta V_{B\text{-}0}$ to potential difference $\Delta V_{A\text{-}0}$, the amount of the mixed lubricant moved to the background portion per unit area increases. As a result, as shown in FIG. 4A, the amount of lubricant 73 in non-image-formation region 70AB is larger than that of background portion 72 of image formation region 70A. Thus, discharge of the lubricant from developing unit 4 is promoted.

As shown in FIG. 3C, as image forming apparatus 100 changes potential difference $\Delta V_{B\text{-}0}$ to potential difference $\Delta V_{C\text{-}0}$, the amount of the mixed lubricant moved to the background portion per unit area decreases. As a result, as shown in FIG. 4B, the amount of lubricant 78 in non-image-formation region 75AB is smaller than that of background portion 72 of image formation region 70A. Thus, discharge of the lubricant from developing unit 4 is suppressed.

Voltage Control in Non-Image-Formation Region

In view of the problems in the case where lubricant application mechanism 14 is provided, the time taken for the amount of the lubricant mixed into developing unit 4 to vary depending on the image portion ratio, and the behavior of the lubricant at the time of development, as described above, image forming apparatus 100 in the present embodiment controls the sticking amount of the mixed lubricant sticking to the non-image-formation region as follows.

Figure 5:
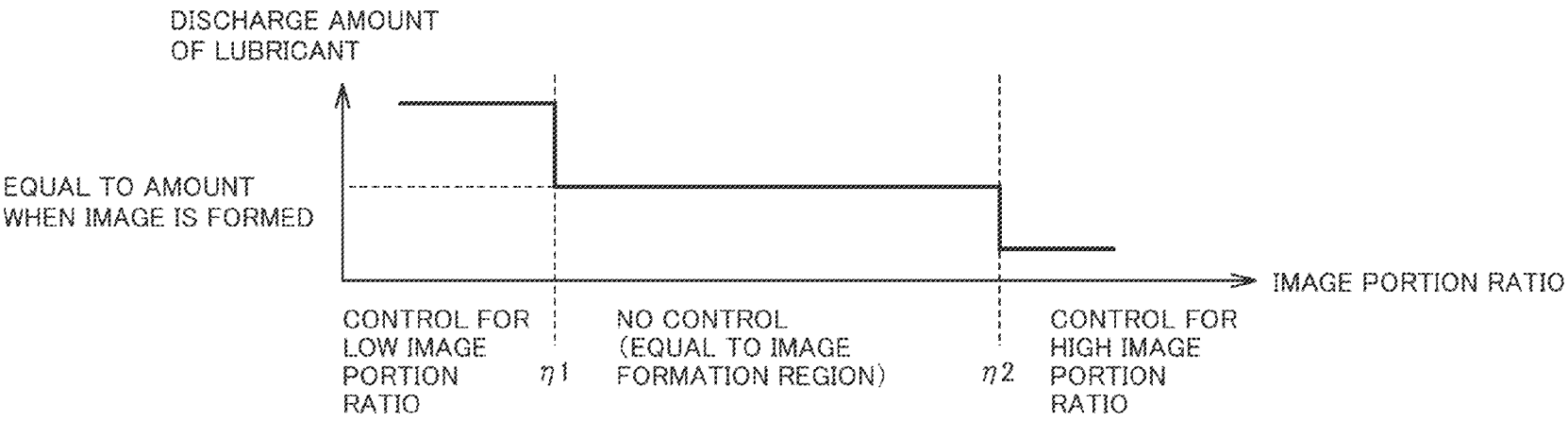
FIG. 5 is a diagram showing a relation between an image portion ratio and a discharge amount of a mixed lubricant in the first embodiment.

FIG. 5 is a diagram showing a relation between the image portion ratio and the discharge amount of the mixed lubricant. Image forming apparatus 100 controls the discharge amount of the mixed lubricant based on the image portion ratio in a certain period in the past.

More specifically, in the case where the image portion ratio in a certain period in the past is lower than a certain value "η1," image forming apparatus 100 determines that a large amount of the lubricant is mixed into developing unit 4 and the charge amount of the toner in developing unit 4 decreases. In this case, image forming apparatus 100 sets the development bias for the non-image-formation region to meet a condition that the discharge amount of the lubricant increases. An example of this condition may be, as shown in FIG. 3B, a condition that the potential applied to developer carrier 10 is changed from potential $V_B$ to potential $V_A$.

In the case where the image portion ratio in a certain period in the past is higher than a certain value "η2," image forming apparatus 100 determines that the lubricant in developing unit 4 decreases and the time for which the toner stays in developing unit 4 is shorter than a certain time, and accordingly determines that the charge amount of the toner in developing unit 4 increases. In this case, image forming apparatus 100 changes the development bias for the non-image-formation region to meet a condition that the discharge amount of the lubricant decreases. An example of this condition may be, as shown in FIG. 3C, a condition that the potential applied to developer carrier 10 is changed from potential $V_B$ to potential $V_C$.

In the example described above, image forming apparatus 100 controls the discharge amount of the mixed lubricant based on the image portion ratio in a certain period in the past. Alternatively, image forming apparatus 100 may estimate the image portion ratio in the future and control the discharge amount of the mixed lubricant based on the estimated image portion ratio. For example, image forming apparatus 100 estimates the future image portion ratio based on images to be formed by a job reserved already. In the case where this image portion ratio is low, image forming apparatus 100 determines that the amount of the lubricant mixed into developing unit 4 from the image formation region in the future increases. Based on this result of determination, image forming apparatus 100 changes the condition of development for the non-image-formation region to meet a condition that the discharge amount of the lubricant increases. Moreover, in the case where the estimated image portion ratio is high, image forming apparatus 100 determines that the amount of the lubricant mixed into developing unit 4 from the image formation region in the future decreases. Based on this result of determination, image forming apparatus 100 changes the condition of development for the non-image-formation region to meet a condition that the discharge amount of the lubricant decreases.

Moreover, although FIG. 5 shows an example where the discharge amount of the mixed lubricant is changed among the three levels, the discharge amount of the mixed lubricant may be changed stepwise among four or more levels.

Figure 6:
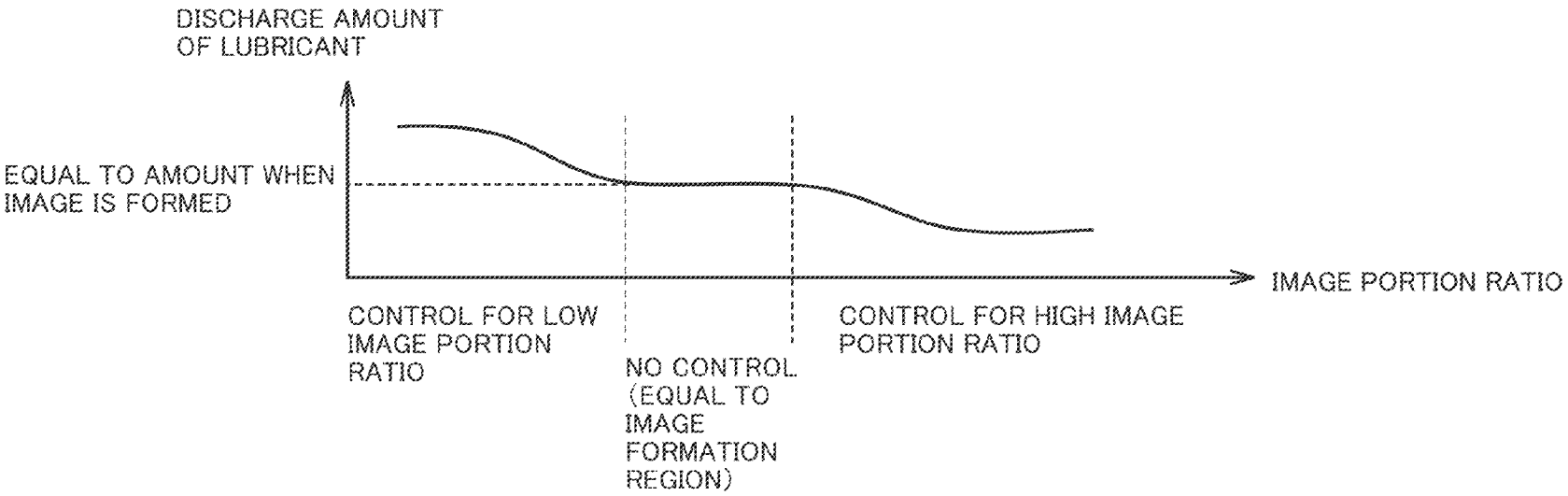
FIG. 6 is a diagram showing a relation between an image portion ratio and a discharge amount of a mixed lubricant.

Further, as shown in FIG. 6, the discharge amount of the mixed lubricant may be changed depending on the image portion ratio. FIG. 6 is a diagram showing a relation between the image portion ratio and the discharge amount of the mixed lubricant according to a modification. As shown in FIG. 6, image forming apparatus 100 may increase the discharge amount of the mixed lubricant with decrease of the image portion ratio. Alternatively, image forming apparatus 100 may decrease the discharge amount of the mixed lubricant with the increase of the image portion ratio.

Control Structure of Image Forming Apparatus 100

Figure 7:
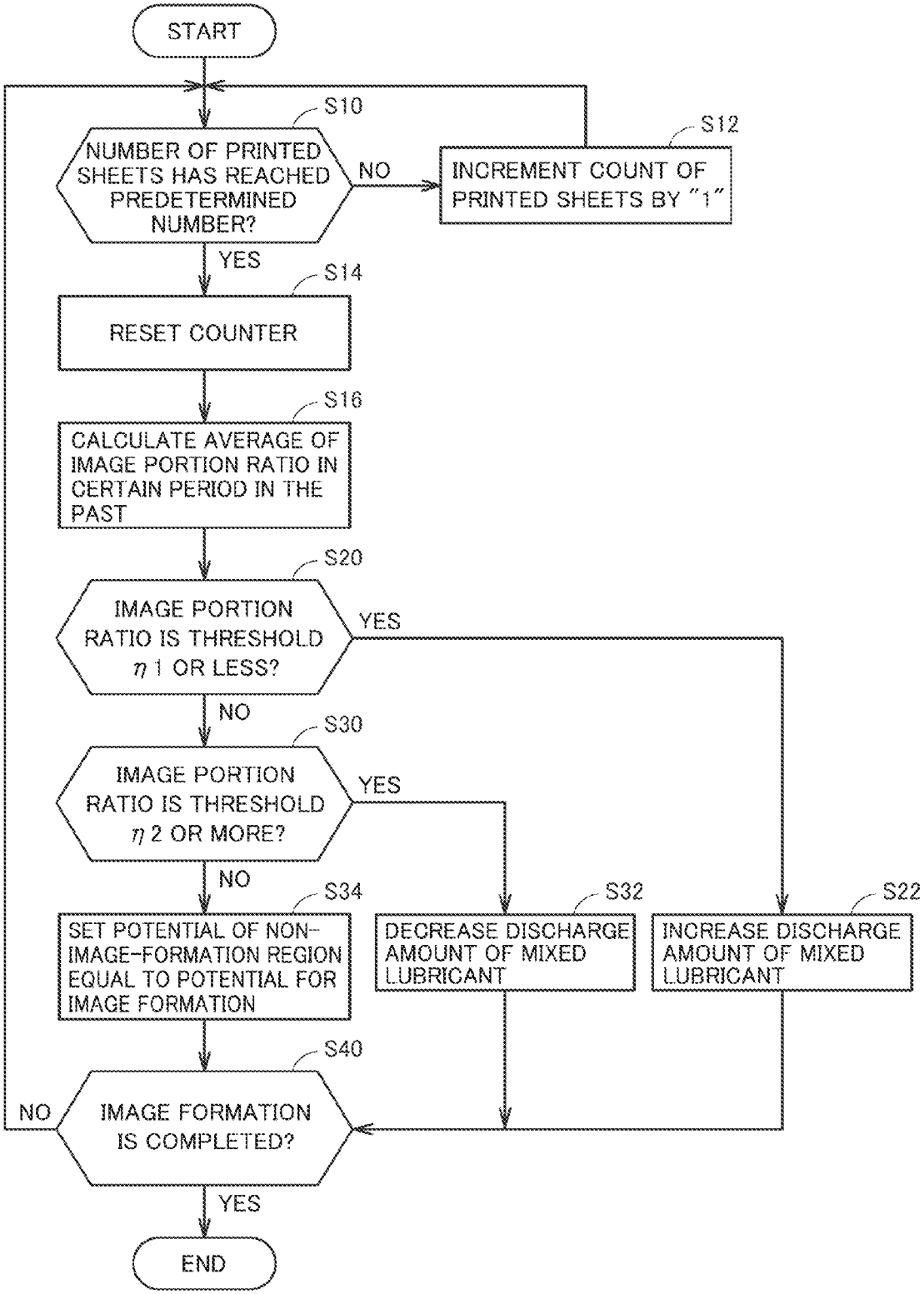
FIG. 7 is a flowchart showing a part of a process executed by an image forming apparatus according to the first embodiment.

Referring to FIG. 7, a description will be given of a control structure of image forming apparatus 100. FIG. 7 is a flowchart showing a part of a process executed by image forming apparatus 100. The process in FIG. 7 is implemented through execution of a program by a CPU (Central Processing Unit) 202 described later herein. In another aspect, a part or the whole of the process may be executed by hardware such as circuit device or the like.

As image formation is started, CPU 202 reads a counter for re-setting a development condition for the non-image-formation region in predetermined cycles and determines whether or not the read count has reached a re-setting timing in step S10. The counter counts the number of printed sheets for example. At the time the number of printed sheets reaches a predetermined number, CPU 202 re-sets a voltage condition for the non-image-formation region. The cycle period for re-setting may be a sufficiently short time relative to the time over which the amount of the mixed lubricant varies depending on the image portion ratio. For example, the cycle period for re-setting is set for each sheet in the case of a short cycle period, and set to several hundreds of sheets in the case of a long cycle period.

When CPU 202 determines that the number of printed sheets reaches a predetermined number (YES in step S10), CPU 202 shifts its control to step S14. Otherwise (NO in step S10), CPU 200 shifts its control to step S12.

In step S12, CPU 202 increments the counter for the number of printed sheets by "1" each time a printing process on a recording medium is performed.

In step S14, CPU 202 resets the counter. Namely, CPU 202 sets the counter to "0."

In step S16, CPU 202 calculates the average of the image portion ratio in a certain period in the past.

In step S20, CPU 202 determines whether or not the average of the image portion ratio in a certain period in the past is equal to or less than a threshold value $\eta 1$.

When CPU 202 determines that the image portion ratio is equal to or less than threshold value $\eta 1$ (YES in step S20), CPU 202 shifts its control to step S22. Otherwise (NO in step S20), CPU 202 shifts its control to step S30.

In step S22, CPU 202 increases the discharge amount of the mixed lubricant to be larger than the current amount. In this case, image forming apparatus 100 sets the development bias for the non-image-formation region to meet a condition that the discharge amount of the lubricant increases. An example of this condition may be, as shown in FIG. 3B, a condition that the potential applied to developer carrier 10 is changed from potential $V_B$ to potential $V_A$.

In step S30, CPU 202 determines whether or not the average of the image portion ratio in a certain period in the past is equal to or more than a threshold value $\eta 2$. When the image portion ratio is equal to or more than threshold value $\eta 2$ (YES in step S30), CPU 202 shifts its control to step S32. Otherwise (NO in step S30), CPU 202 shifts its control to step S34.

In step S32, CPU 202 reduces the discharge amount of the mixed lubricant to be smaller than the current amount. In this case, image forming apparatus 100 sets the development bias for the non-image-formation region to meet a condition that the discharge amount of the lubricant decreases. An example of this condition may be, as shown in FIG. 3C, a condition that the potential applied to developer carrier 10 is changed from potential $V_B$ to potential $V_C$.

In step S34, CPU 202 adjusts the discharge amount of the mixed lubricant for the non-image-formation region to meet the image formation region. Namely, CPU 202 determines that it is unnecessary to change the discharge amount of the mixed lubricant for the non-image-formation region and sets the development bias for the non-image-formation region to potential $V_B$, like the bias for the image formation region, as shown in FIG. 3A.

In step S40, CPU 202 determines whether or not the whole image formation process is completed. When CPU 202 determines that the whole image formation process is completed (YES in step S40), CPU 202 ends the control process in the present embodiment. Otherwise (NO in step S40), CPU 202 returns its control to step S10. Namely, CPU 202 executes again the process of setting the development condition for the non-image-formation region.

Example of Development Condition for Controlling Discharge Amount of Mixed Lubricant In the above-described example, the development condition for controlling the discharge amount of the mixed lubricant is determined in accordance with the method as shown in FIG. 3A to FIG. 3C of changing the development bias for developer carrier 10 to potential $V_A$ to $V_C$. The development condition, however, is not limited to this. In the following, other development conditions will be described one by one with reference to FIG. 8A to FIG. 8C, FIG. 9, and FIG. 10A to FIG. 10C.

First Modification

Figure 8A:
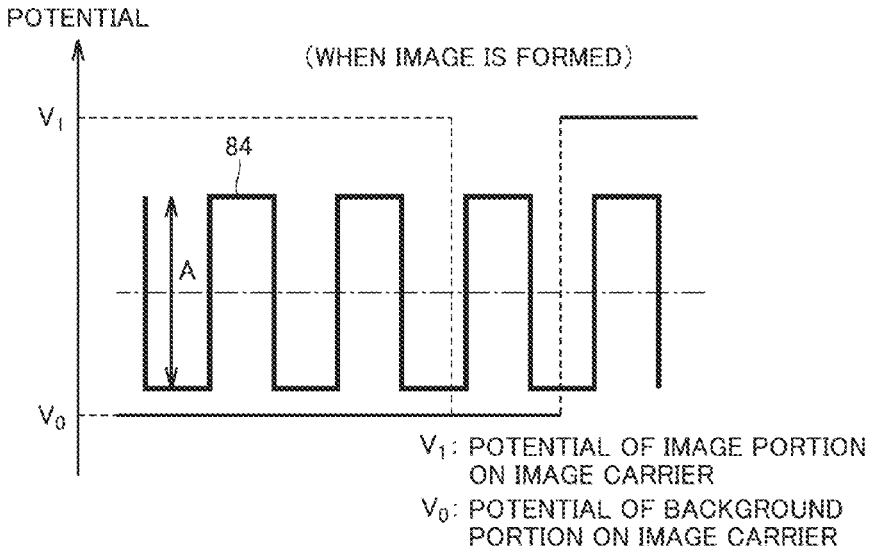
FIG. 8A, FIG. 8B, and FIG. 8C are each a diagram showing a development condition according to a first modification.
Figure 8B:
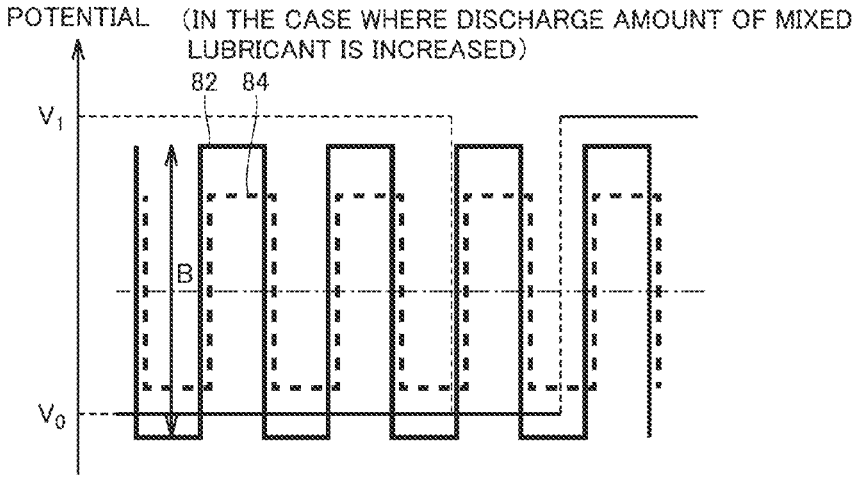
Figure 8C:
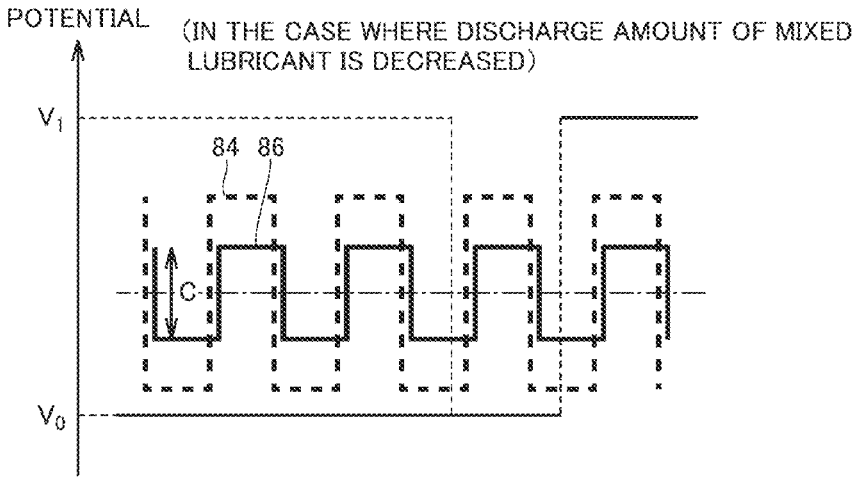

FIG. 8A, FIG. 8B, and FIG. 8C are each a diagram showing a development condition according to a first modification. FIG. 8A shows a development bias 84 applied to developer carrier 10 at the time of image formation. Development bias 84 includes an AC component voltage in addition to a DC component voltage. Image forming apparatus 100 changes the frequency (peak to peak) of development bias 84 to control the discharge amount of the mixed lubricant.

As shown in FIG. 8B, in the case where images with a low image portion ratio are successively given, image forming apparatus 100 sets development bias 84 applied to developer carrier 10 to a development bias 82. Namely, image forming apparatus 100 increases the amplitude of the development bias from amplitude A to amplitude B. Accordingly, movement of the toner and lubricant particles at the development NIP is promoted. As a result, separation of the lubricant particles from the toner is promoted and the probability that the separated lubricant particles are brought into contact with the surface of image carrier 1 increases. Thus, the sticking amount of the mixed lubricant sticking to the non-image-formation region increases.

As shown in FIG. 8C, in the case where images with a high image portion ratio are successively given, image forming apparatus 100 sets development bias applied to developer carrier 10 to a development bias 86. Namely, image forming apparatus 100 reduces the amplitude of the development bias from normal amplitude A to amplitude C. Accordingly, movement of the toner and the lubricant particles at the development NIP is suppressed. As a result, separation of the lubricant particles from the toner is suppressed and the probability that the separated lubricant particles are brought into contact with the surface of image carrier 1 decreases. Thus, the sticking amount of the mixed lubricant sticking to the non-image-formation region decreases.

As seen from the above, in this modification, image forming apparatus 100 changes the amplitude of the AC voltage applied to developer carrier 10 to thereby change the potential difference between the mixed lubricant and developer carrier 10. In this way, image forming apparatus 100 can adjust the amount of the mixed lubricant which moves from developer carrier 10 to image carrier 1.

Second Modification

Figure 9:
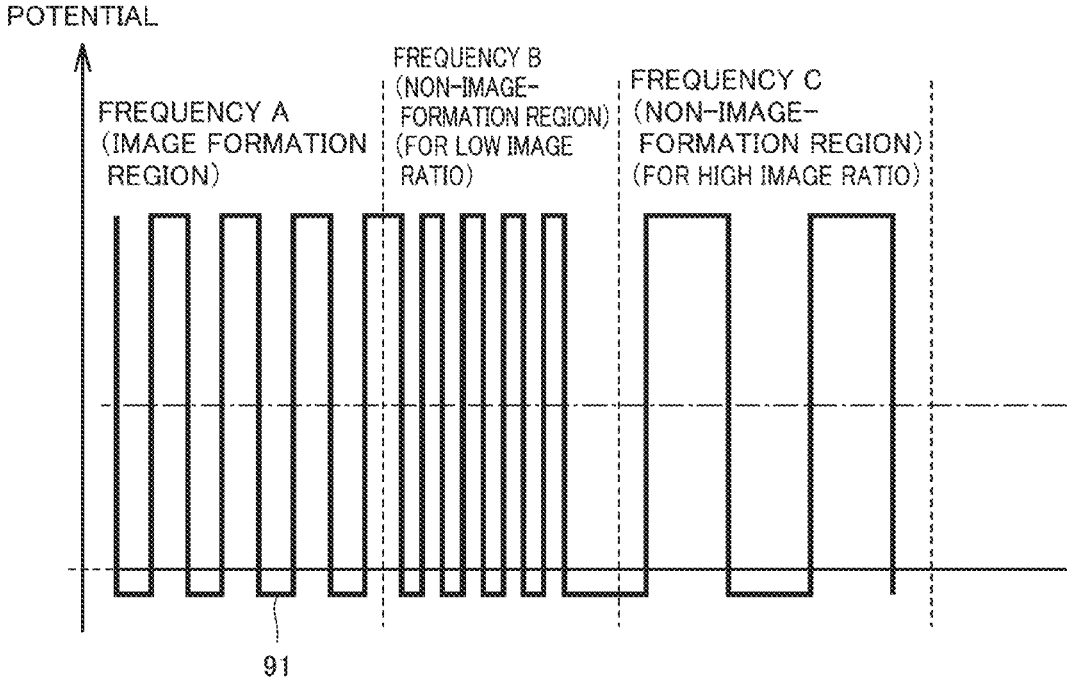
FIG. 9 is a diagram showing a development condition according to a second modification.

FIG. 9 is a diagram showing a development condition according to a second modification. FIG. 9 shows a development bias 91 applied to developer carrier 10. Development bias 91 includes an AC component voltage in addition to a DC component voltage. Image forming apparatus 100 controls the discharge amount of the mixed lubricant by changing the frequency of development bias 91.

In the case where images with a low image portion ratio are successively given, image forming apparatus 100 increases the frequency of development bias 91 from frequency A to frequency B. Accordingly, movement of the toner and the lubricant particles at the development NIP is promoted. As a result, separation of the lubricant particles from the toner is promoted and the probability that the separated lubricant particles are brought into contact with the surface of image carrier 1 increases. Thus, the sticking amount of the mixed lubricant sticking to the non-image-formation region increases.

In the case where images with a high image portion ratio are successively given, image forming apparatus 100 reduces the frequency of development bias 91 from frequency A to frequency C. Accordingly, movement of the toner and the lubricant particles at the development NIP is suppressed. As a result, separation of the lubricant particles from the toner is suppressed and the probability that the separated lubricant particles are brought into contact with the surface of image carrier 1 decreases. Thus, the sticking amount of the mixed lubricant sticking to the non-image-formation region decreases.

As seen from the above, in this modification, image forming apparatus 100 increases the frequency of the AC voltage applied to developer carrier 10, with the decrease of the image portion ratio. Moreover, image forming apparatus 100 reduces the frequency of the AC voltage applied to developer carrier 10, with the increase of the image portion ratio. In this way, image forming apparatus 100 controls the discharge amount of the mixed lubricant.

Third Modification

Figure 10A:
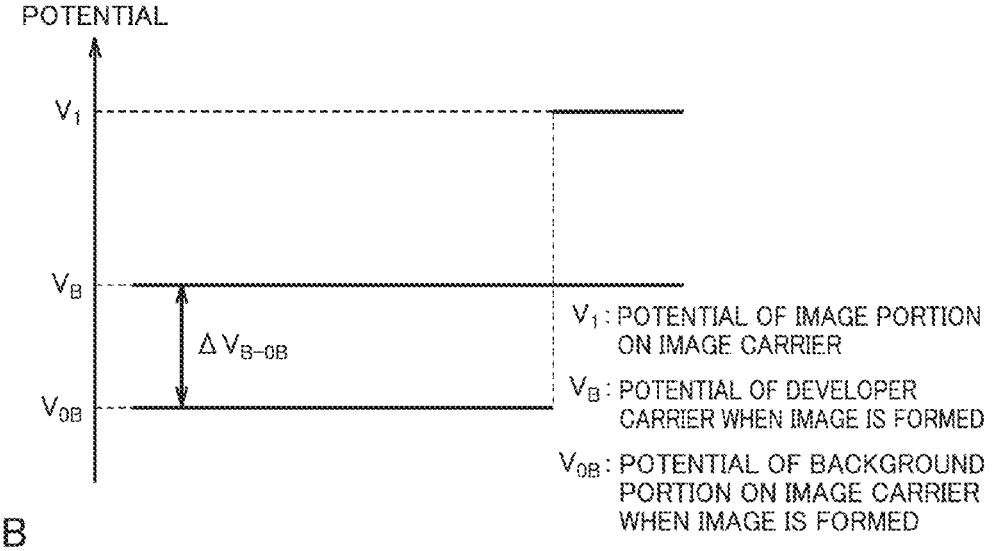
FIG. 10A, FIG. 10B, and FIG. 10C are each a diagram showing a development condition according to a third modification.
Figure 10B:
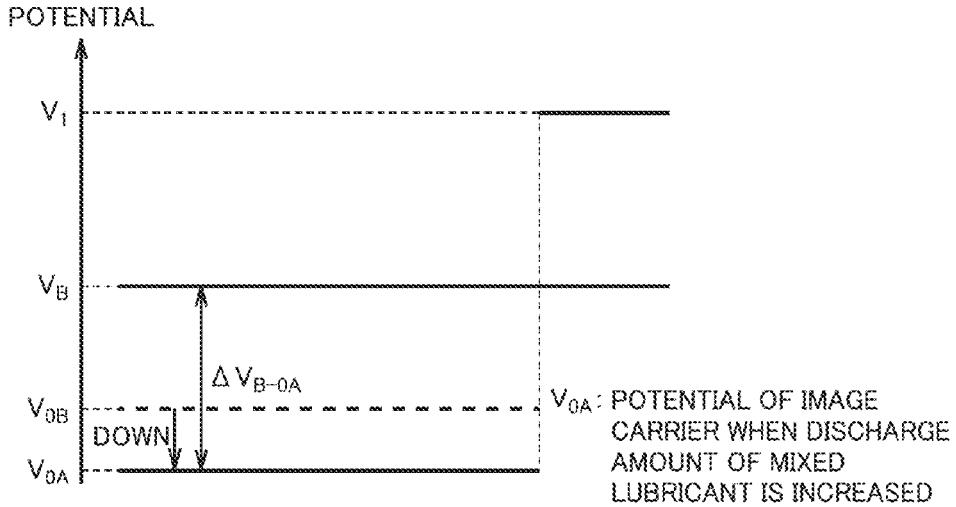
Figure 10C:
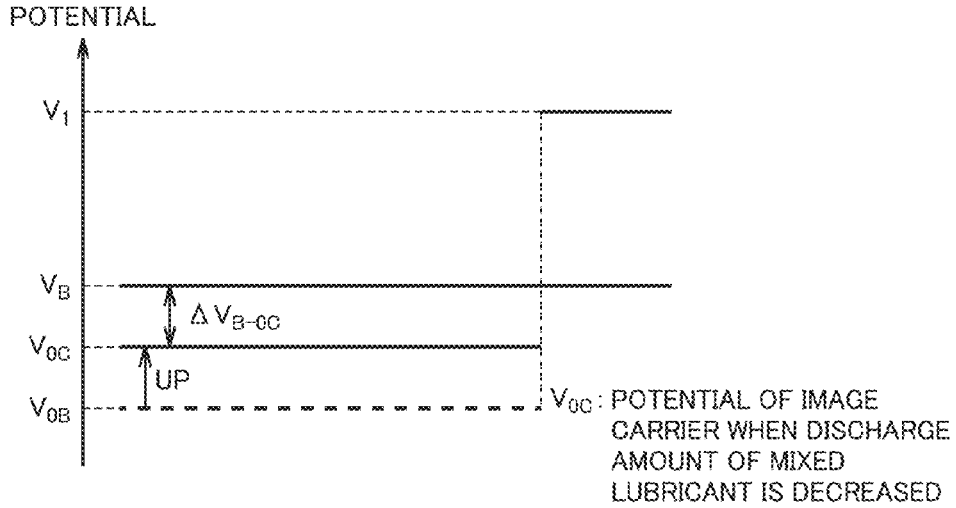

FIG. 10A, FIG. 10B, and FIG. 10C are each a diagram showing a development condition according to a third modification. Image forming apparatus 100 may change the development condition by changing the potential for image carrier 1, rather than the development bias for developer carrier 10. Namely, image forming apparatus 100 changes the development condition by making constant the potential to developer carrier 10 and applying different potentials to the non-image-formation region, the image portion of the image formation region, and the background portion of the image formation region of image carrier 1.

As shown in FIG. 10A, at the time of image formation, image forming apparatus 100 applies potential $V_1$ to the image portion of the image formation region, and potential $V_{0B}$ to the background portion of the image formation region. Image forming apparatus 100 applies potential $V_B$ to developer carrier 10.

As shown in FIG. 10B, in the case where images with a low image portion ratio are successively given, image forming apparatus 100 lowers the potential for the background portion of image carrier 1 in the non-image-formation region from potential $V_{0B}$ to potential $V_{0A}$. Image forming apparatus 100 sets smaller the potential for the background portion in the non-image-formation region and accordingly the potential difference between image carrier 1 and developer carrier 10 changes from potential difference $\Delta V_{B\text{-}0B}$ to potential difference $\Delta V_{B\text{-}0A}$. This increase of the potential difference causes the electric field acting on image carrier 1 and developer carrier 10 to become strong. As a result, movement of the lubricant particles to image carrier 1 is promoted and discharge of the lubricant to the non-image-formation region of image carrier 1 is promoted.

As shown in FIG. 10C, in the case where images with a high image portion ratio are successively given, image forming apparatus 100 increases the potential for the background portion of image carrier 1 in the non-image-formation region from potential $V_{0B}$ to potential $V_{0C}$. Image forming apparatus 100 sets larger the potential for the background portion in the non-image-formation region, and accordingly the potential difference between image carrier 1 and developer carrier 10 changes from potential difference $\Delta V_{B\text{-}0B}$ to potential difference $AV_{B\text{-}0C}$. This reduction of the potential difference causes the electric field acting on image carrier 1 and developer carrier 10 to become weak. As a result, movement of the lubricant particles to image carrier 1 is suppressed and discharge of the lubricant to the non-image-formation region of image carrier 1 is suppressed.

In this way, in the present modification, image forming apparatus 100 changes the voltage applied to the non-image-formation region to thereby change the potential difference between the mixed lubricant and the non-image formation region. Thus, image forming apparatus 100 controls the discharge amount of the mixed lubricant.

Fourth Modification

Depending on the image forming apparatus, the development condition as described above may be set variably depending on various circumstances at the time of image formation. In this case, a development condition at the time of image formation immediately before determination of the above-described control may be used as a reference, and image forming apparatus 100 may change the development condition for the non-image-formation region relative to the reference, based on the control.

Functional Configuration of Image Forming Apparatus 100

Figure 11:
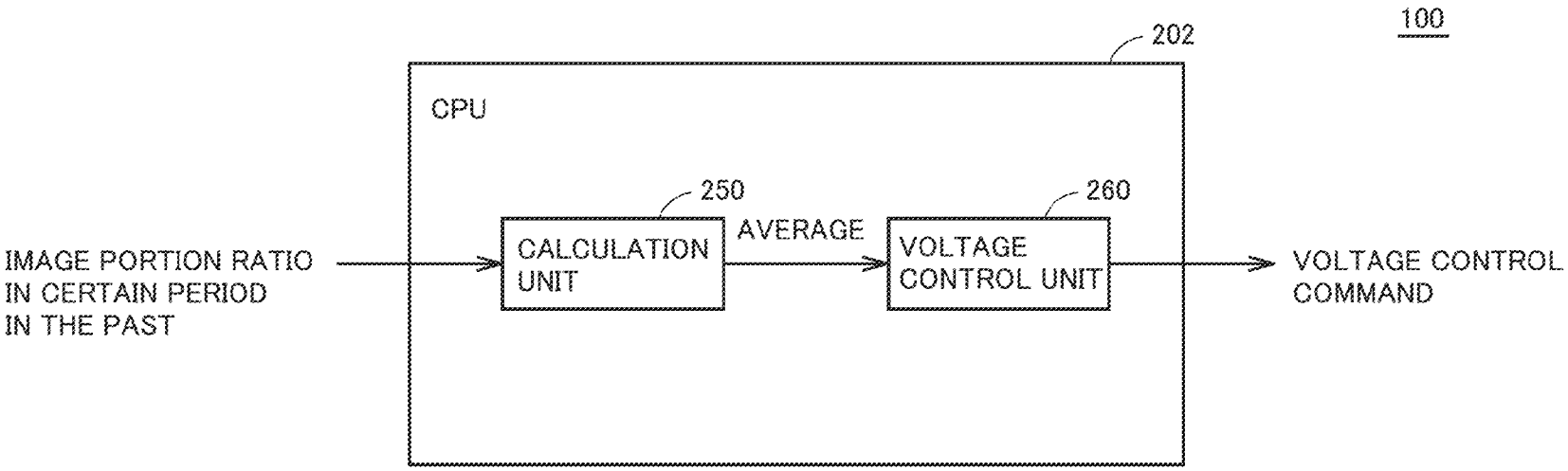
FIG. 11 is a block diagram showing an example of a functional configuration of the image forming apparatus according to the first embodiment.

Referring to FIG. 11, functions of image forming apparatus 100 will be described. FIG. 11 is a block diagram showing an example of a functional configuration of image forming apparatus 100. As shown in FIG. 11, image forming apparatus 100 includes CPU 202. CPU 202 includes a calculation unit 250 and a voltage control unit 260 as functional elements.

Calculation unit 250 calculates the image portion ratio which represents the ratio of a toner sticking region to an electrostatic latent image or toner image. Each image portion ratio is derived from information for forming the electrostatic latent image, for example. By way of example, calculation unit 250 calculates the average of the image portion ratio in a certain period in the past. Calculation unit 250 outputs to voltage control unit 260 the average of the image portion ratio in a certain period in the past.

Voltage control unit 260 causes the lubricant, which is mixed into developer 4 in the process of developing a toner image, to stick to developer carrier 10, and also changes the sticking amount of the mixed lubricant that is caused to stick to a non-image-formation region in image carrier 1. By way of example, voltage control unit 260 changes the sticking amount of the mixed lubricant by controlling a power supply which applies a voltage to developer carrier 10 in developing unit 4.

In an aspect, voltage control unit 260 reduces the sticking amount of the mixed lubricant, as the average of the image portion ratio in a certain period in the past increases. In another aspect, voltage control unit 260 increases the sticking amount of the mixed lubricant, as the average of the image portion ratio in a certain period in the past decreases.

SUMMARY

As seen from the foregoing, the amount of the mixed lubricant increases as the image portion ratio decreases. Image forming apparatus 100 in the present embodiment increases the discharge amount of the mixed lubricant as the image portion ratio decreases. On the contrary, the amount of the mixed lubricant decreases as the image portion ratio increases. Image forming apparatus 100 reduces the discharge amount of the mixed lubricant, as the image portion ratio increases.

In this way, image forming apparatus 100 can keep constant the amount of the lubricant mixed into the developing unit. As a result, image forming apparatus 100 can keep the printing quality constant.

Second Embodiment

In the following, an image forming apparatus 100 in a second embodiment will be described. In the second embodiment, image forming apparatus 100 does not perform such control that causes the whole of a non-image-formation region to have a background-portion potential, but exposes image carrier 1 in such a manner that causes a part of the non-image-formation region to have an image-portion potential. Namely, image forming apparatus 100 develops a toner image not only in the image formation region but also in the non-image-formation region. In the following, the toner image formed in the non-image-formation region will also be referred to as "patch image."

It should be noted that the hardware configuration and the like of image forming apparatus 100 in the second embodiment is the same as that of image forming apparatus 100 in the first embodiment. Therefore, the description thereof will not be repeated herein.

Patch Image

Image forming apparatus 100 in the present embodiment includes a control mechanism (not shown) for forming the patch image. Namely, image forming apparatus 100 has a function of forming a toner image (patch image) in a non-image-formation region which is provided separately from a normal image formation region corresponding to an image of an original.

When image forming apparatus 100 forms the patch image in the non-image-formation region, image forming apparatus 100 controls the operation of at least one of charging device 2, exposure device 3, and developing unit 4. Typically, image forming apparatus 100 causes exposure device 3 to selectively apply light to a region where the patch image is to be formed on the surface of image carrier 1 which is uniformly electrically charged by charging device 2. Accordingly, the toner sticks to the exposed region to which the light is applied, and thereby forms a toner image.

It is not essentially desirable to form the patch image, because the toner is consumed for the patch image in addition to image formation. However, as described above, in the case where images with a low image portion ratio are successively given, the time for which the toner stays in the developing unit becomes excessively long, which reduces the charge amount of the toner due to the different factor from the mixed lubricant. Therefore, only when images with a low image portion ratio are successively given, image forming apparatus 100 forms the patch image in the non-image-formation region in order to promote replacement of the toner.

Problem

A description will be given of a problem in causing the mixed lubricant and the toner image to stick to one non-image-formation region. In order to ensure minimal replacement of the toner, image forming apparatus 100 discharges, per image formation time, a constant amount of toner for forming the patch image. In view of the fact that formation of the patch image consumes the toner, it is desirable that the discharge amount of the toner for forming the patch image is a minimum required amount.

Control of the discharge of the mixed lubricant requires change of the development condition, as described above. Therefore, when image forming apparatus 100 simultaneously performs discharge of the mixed lubricant and discharge of the toner for the non-image-formation region, it is necessary for image forming apparatus 100 to form the patch image under a different development condition from normal image formation. Normally, image forming apparatus 100 is configured to stably form an image without being influenced by environmental variations, endurance variation, and the like. Namely, image forming apparatus 100 adjusts the charging condition, the development condition, the exposure condition, and the like one after another so that a constant amount of the toner sticks to form an image. Image forming apparatus 100 may use the development condition for the image formation as it is to form the patch image. Image forming apparatus 100 can thus manage the amount of the toner sticking to the patch image and control the discharge amount of the toner depending on the size of the patch image. In this way, image forming apparatus 100 can precisely manage the discharge amount of the toner.

However, when the process of discharging the mixed lubricant and the process of discharging the toner are simultaneously performed for one non-image-formation region, the aforementioned condition is not met. Therefore, image forming apparatus 100 cannot accurately manage the amount of the toner sticking to the patch image. As a result, wasteful use of the toner, excessive replacement of the toner, and the like occur. Due to decrease of the charge amount of the toner, the printing quality is deteriorated.

Figure 12:
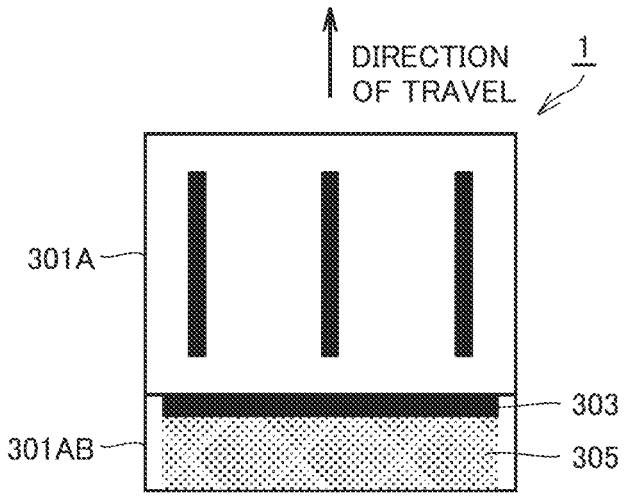
FIG. 12 is a diagram showing an example in which a mixed lubricant and a toner image are stuck to one non-image-formation region.

FIG. 12 is a diagram showing an example where the mixed lubricant and the toner image are caused to stick to one non-image-formation region. In FIG. 12, an image formation region 301A and a non-image-formation region 301AB on image carrier 1 are shown.

In the case where the image portion ratio is particularly low, image forming apparatus 100 has to perform both the discharge of the toner and the discharge of the mixed lubricant. In the example of FIG. 12, image forming apparatus 100 forms a patch image 303 and discharges mixed lubricant 305 on one non-image-formation region 301AB. In such a case, the development condition for forming the patch image is influenced by the development condition for the low image portion ratio. Therefore, image forming apparatus 100 has to form the patch image on a condition different from the normal image formation.

Process of Image Forming Apparatus 100

Figure 13:
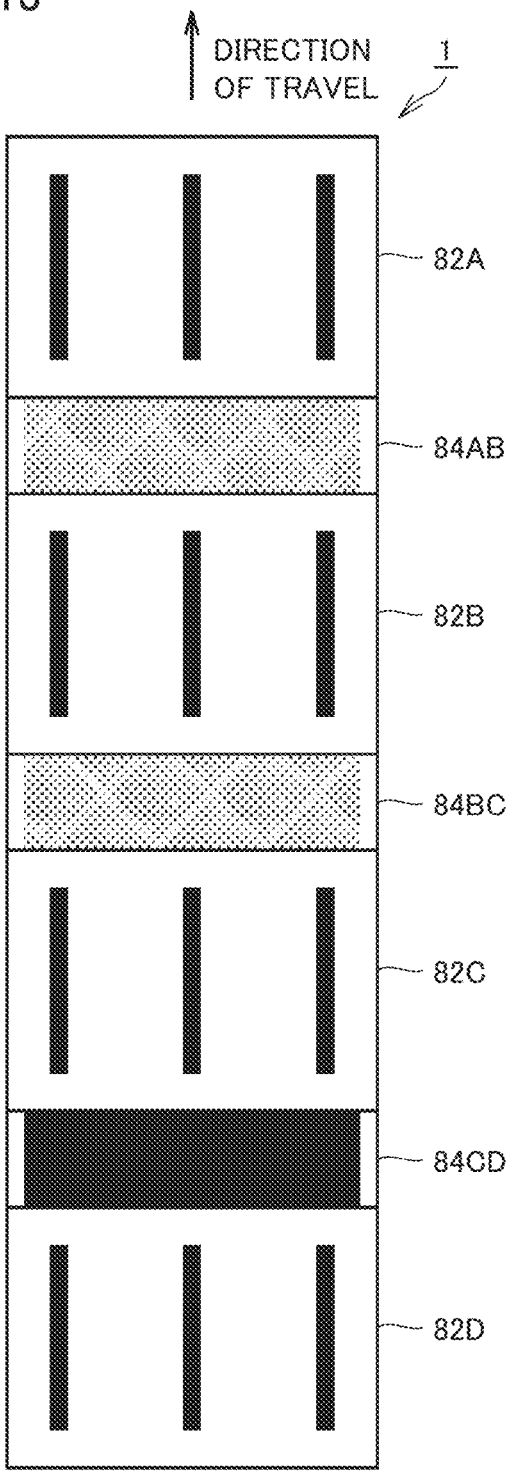
FIG. 13 is a diagram showing an example in which a mixed lubricant and a toner image are stuck to respective different non-image-formation regions.

Referring to FIG. 13, a process of image forming apparatus 100 in the second embodiment will be described. FIG. 13 is a diagram showing an example where the mixed lubricant and the toner image are caused to stick to separate non-image-formation regions.

In the present embodiment, image forming apparatus 100 separately sets a non-image-formation region for forming a patch image on the same development condition as the image formation region, and a non-image-formation region for discharging the mixed lubricant on the development condition for discharging the mixed lubricant. Namely, for one non-image-formation region, image forming apparatus 100 performs one of formation of the patch image and discharge of the mixed lubricant.

In the example of FIG. 13, image forming apparatus 100 performs only the process of discharging the mixed lubricant for a non-image-formation region 84AB between image formation regions 82A and 82B. Image forming apparatus 100 performs only the process of discharging the mixed lubricant for a non-image-formation region 84BC between image formation regions 82B and 82C. Image forming apparatus 100 performs only the process of forming a patch image for a non-image-formation region 84CD between image formation regions 82C and 82D.

SUMMARY

As seen from the above, image forming apparatus 100 in the present embodiment has, as its operation modes, a first mode of causing the toner to stick to a non-image-formation region and discharging the toner from the developing unit, and a second mode of causing the mixed lubricant to stick to a non-image-formation region and discharging the mixed lubricant from the developing unit. Image forming apparatus 100 functions as an operation mode control unit, and controls the operation mode so that sticking of the toner in the first mode and sticking of the lubricant in the second mode do not occur to one non-image-formation region.

In this way, image forming apparatus 100 can accurately manage the amount of the toner discharged for a patch image, based on the area of the patch image, can precisely control the amount of the discharged toner, and can also discharge, to the maximum extent, the mixed lubricant in the case of a low image portion ratio.

Although the present invention has been described and illustrated in detail, it is clearly understood that the same is by way of illustration and example only and is not to be taken by way of limitation, the scope of the present invention being interpreted by the terms of the appended claims.

What is claimed is:

1. An image forming apparatus comprising:

an image carrier;

an image forming unit configured to form, on the image carrier, an electrostatic latent image corresponding to an input image;

a developing unit including a toner carrier configured to develop, on the image carrier, a toner image corresponding to the electrostatic latent image, by causing a toner held in the developing unit to stick to the image carrier;

an application unit configured to apply a lubricant onto the image carrier;

a calculation unit configured to calculate an image portion ratio which represents a ratio of a toner sticking region to the electrostatic latent image or the toner image; and a control unit configured to cause the lubricant mixed into the developing unit in a process of developing the toner image, to stick to the toner carrier, and change, depending on the image portion ratio, an amount of the lubricant caused to stick to a non-image-formation region which is a region on the image carrier and in which the electrostatic latent image or the toner image is not formed.

2. The image forming apparatus according to claim 1, wherein the control unit is configured to decrease the amount of the lubricant mixed into the developing unit and caused to stick to the non-image-formation region, as the image portion ratio increases.

3. The image forming apparatus according to claim 1, wherein the control unit is configured to increase the amount of the lubricant mixed into the developing unit and caused to stick to the non-image-formation region, as the image portion ratio decreases.

4. The image forming apparatus according to claim 1, wherein the control unit is configured to stepwise change, among three or more levels, the amount of the lubricant caused to stick to the non-image-formation region, depending on the image portion ratio.

5. The image forming apparatus according to claim 1, wherein the control unit is configured to control a voltage applied to at least one of the non-image-formation region and the toner carrier, so that a first potential difference between the lubricant mixed into the developing unit and the non-image-formation region is smaller than a second potential difference between the lubricant and the toner carrier, as the image portion ratio increases.

6. The image forming apparatus according to claim 5, wherein the control unit is configured to apply an AC voltage to the toner carrier, and change the second potential difference by changing an amplitude of the AC voltage.

7. The image forming apparatus according to claim 5, wherein the control unit is configured to change the first potential difference by changing a voltage applied to the non-image-formation region.

8. The image forming apparatus according to claim 1, wherein the control unit is configured to apply an AC voltage to the toner carrier, and lower a frequency of the AC voltage as the image portion ratio increases.

9. The image forming apparatus according to claim 1, wherein the image forming apparatus has, as operation modes, a first mode of causing the toner to stick to the non-image-formation region and discharging the toner from the developing unit; and a second mode of causing the lubricant to stick to the non-image-formation region and discharging the lubricant from the developing unit, and the image forming apparatus further comprises an operation mode control unit configured to control the operation modes so that sticking of the toner in the first mode and sticking of the lubricant in the second mode are not performed for the one non-image-formation region.

10. A control method for an image forming apparatus, the image forming apparatus comprising:

an image carrier;

an image forming unit configured to form, on the image carrier, an electrostatic latent image corresponding to an input image;

a developing unit including a toner carrier configured to develop, on the image carrier, a toner image corresponding to the electrostatic latent image, by causing a toner held in the developing unit to stick to the image carrier; and an application unit configured to apply a lubricant onto the image carrier, the control method comprising:

calculating an image portion ratio which represents a ratio of a toner sticking region to the electrostatic latent image or the toner image;

causing the lubricant mixed into the developing unit in a process of developing the toner image, to stick to the toner carrier; and changing, depending on the image portion ratio, an amount of the lubricant caused to stick to a non-image-formation region which is a region on the image carrier and in which the electrostatic latent image or the toner image is not formed.

11. The control method according to claim 10, wherein the changing an amount of the lubricant caused to stick to a non-image-formation region includes decreasing the amount of the lubricant mixed into the developing unit and caused to stick to the non-image-formation region, as the image portion ratio increases.

12. The control method according to claim 10, wherein the changing an amount of the lubricant caused to stick to a non-image-formation region includes increasing the amount of the lubricant mixed into the developing unit and caused to stick to the non-image-formation region, as the image portion ratio decreases.

13. The control method according to claim 10, wherein the changing an amount of the lubricant caused to stick to a non-image-formation region includes stepwise changing, among three or more levels, the amount of the lubricant caused to stick to the non-image-formation region, depending on the image portion ratio.

14. The control method according to claim 10, wherein the changing an amount of the lubricant caused to stick to a non-image-formation region includes controlling a voltage applied to at least one of the non-image-formation region and the toner carrier, so that a first potential difference between the lubricant mixed into the developing unit and the non-image-formation region is smaller than a second potential difference between the lubricant and the toner carrier, as the image portion ratio increases.

15. A non-transitory storage medium encoded with a computer readable program executed by a computer of an image forming apparatus, the image forming apparatus comprising:

an image carrier;

an image forming unit configured to form, on the image carrier, an electrostatic latent image corresponding to an input image;

a developing unit including a toner carrier configured to develop, on the image carrier, a toner image corresponding to the electrostatic latent image, by causing a toner held in the developing unit to stick to the image carrier; and an application unit configured to apply a lubricant onto the image carrier, the program causing the image forming apparatus to calculate an image portion ratio which represents a ratio of a toner sticking region to the electrostatic latent image or the toner image, cause the lubricant mixed into the developing unit in a process of developing the toner image, to stick to the toner carrier; and change, depending on the image portion ratio, an amount of the lubricant caused to stick to a non-image-formation region which is a region on the image carrier and in which the electrostatic latent image or the toner image is not formed.

16. The non-transitory storage medium according to claim 15, wherein to change an amount of the lubricant caused to stick to a non-image-formation region includes to decrease the amount of the lubricant mixed into the developing unit and caused to stick to the non-image-formation region, as the image portion ratio increases.

17. The non-transitory storage medium according to claim 15, wherein to change an amount of the lubricant caused to stick to a non-image-formation region includes to increase the amount of the lubricant mixed into the developing unit and caused to stick to the non-image-formation region, as the image portion ratio decreases.

18. The non-transitory storage medium according to claim 15, wherein to change an amount of the lubricant caused to stick to a non-image-formation region includes to stepwise change, among three or more levels, the amount of the lubricant caused to stick to the non-image-formation region, depending on the image portion ratio.

19. The non-transitory storage medium according to claim 15, wherein to change an amount of the lubricant caused to stick to a non-image-formation region includes to control a voltage applied to at least one of the non-image-formation region and the toner carrier, so that a first potential difference between the lubricant mixed into the developing unit and the non-image-formation region is smaller than a second potential difference between the lubricant and the toner carrier, as the image portion ratio increases.

* * * * *